US012779616B2

(12) United States Patent
Numata

(10) Patent No.: US 12,779,616 B2
(45) Date of Patent: Nov. 3, 2026

(54) GRINDING TOOL

(71) Applicant: MAKITA CORPORATION, Anjo (JP)

(72) Inventor: Fumitoshi Numata, Anjo (JP)

(73) Assignee: MAKITA CORPORATION, Anjo (JP)

( * ) Notice: Subject to any disclaimer, the term of this patent is extended or adjusted under 35 U.S.C. 154(b) by 646 days.

(21) Appl. No.: 18/317,257

(22) Filed: May 15, 2023

(65) Prior Publication Data

US 2024/0017369 A1 Jan. 18, 2024

(30) Foreign Application Priority Data

Jul. 12, 2022 (JP) ..... 2022-111978

(51) Int. Cl.
*B24B 23/02* (2006.01)

(52) U.S. Cl.
CPC ..... *B24B 23/028* (2013.01)

(58) Field of Classification Search
CPC ..... B24B 23/028; B24B 47/12; B24B 49/10; B24B 41/007; B24B 41/044; B25F 5/001; B25F 5/006; H02K 7/145
USPC ..... 451/344, 359, 451; 173/11, 2, 181
See application file for complete search history.

(56) References Cited

U.S. PATENT DOCUMENTS

2013/0186661 A1 7/2013 Okubo et al.
2017/0234484 A1* 8/2017 Vanko ..... B24B 23/028 173/176
2020/0384627 A1 12/2020 Numata

FOREIGN PATENT DOCUMENTS

GB 2598736 A * 3/2022 ..... B24B 23/022
JP 2012-076160 A 4/2012
JP 2012-115170 A 6/2012
JP 2020-199590 A 12/2020
JP 2021-142601 A 9/2021

OTHER PUBLICATIONS

Dec. 2, 2025 Office Action issued in Japanese Patent Application No. 2022-111978.

* cited by examiner

*Primary Examiner* — Robert F Neibaur
(74) *Attorney, Agent, or Firm* — Oliff PLC

(57) ABSTRACT

To reduce wasteful power consumption and noise generation, a control circuit drives a motor in response to a switch being turned on after a handle detector detects attachment of an auxiliary handle and a handle gripping detector detects gripping of the auxiliary handle, controls the motor to rotate at a predetermined first rotational speed in response to the switch being turned on with the attachment and the gripping of the auxiliary handle being detected, and controls the motor to rotate at a second rotational speed lower than the first rotational speed in response to a state of a load on a tip tool being unchanged for a predetermined period of time.

22 Claims, 16 Drawing Sheets

GRINDING TOOL

CROSS-REFERENCE TO RELATED APPLICATIONS

This application claims the benefit of priority to Japanese Patent Application No. 2022-111978, filed on Jul. 12, 2022, the entire contents of which are hereby incorporated by reference.

BACKGROUND

1. Technical Field

The present disclosure relates to a grinding tool such as a grinder. In one or more embodiments of the present disclosure, grinding includes polishing.

2. Description of the Background

A grinder as an example of a grinding tool includes a spindle protruding downward from a front portion of a housing extending in a front-rear direction and accommodating a motor. The spindle has a lower end to receive a tip tool, such as a grinding disc. The tip tool rotates together with the spindle for grinding and other operations on a workpiece.

A grinder described in Japanese Unexamined Patent Application Publication No. 2020-199590 (hereafter referred to as Patent Literature 1) includes a housing extending in the front-rear direction with a rear portion as a main handle of the grinder. A side handle (auxiliary handle) is attachable selectively on either the left side or right side of the front portion of the housing. An operator holds the rear portion of the housing with one hand and the side handle with the other hand to operate the grinder.

Such a known grinder includes a handle detector that electrically detects attachment of the auxiliary handle to prevent kickback in which the grinder is swung around with a reaction force received by the tip tool from a workpiece. Although a switch is turned on, a controller does not drive a motor unless the controller obtains a detection signal from the handle detector.

BRIEF SUMMARY

Some known grinders may allow their motors to continuously rotate at the same speed when no operation is performed or when a tip tool is out of contact with a workpiece. This causes wasteful power consumption as well as noise generation.

One or more aspects of the present disclosure are directed to a grinding tool that can reduce wasteful power consumption and noise generation.

A first aspect of the present disclosure provides a grinding tool, including:

a housing accommodating a motor;

a spindle protruding from the housing and being rotatable upon being driven by the motor, the spindle having an end to receive a tip tool;

a switch to be turned on or off in response to an external operation;

a controller configured to control driving of the motor in response to the switch being turned on or off;

a handle mount on the housing to receive an auxiliary handle in a detachable manner;

a handle detector configured to electrically detect an attachment state of the auxiliary handle to the handle mount; and a handle gripping detector configured to electrically detect a gripping state of the auxiliary handle attached to the handle mount, wherein the controller drives the motor in response to the switch being turned on after the handle detector detects attachment of the auxiliary handle and the handle gripping detector detects gripping of the auxiliary handle, controls the motor to rotate at a predetermined first rotational speed in response to the switch being turned on with the attachment and the gripping of the auxiliary handle being detected, and controls the motor to rotate at a second rotational speed lower than the first rotational speed in response to a state of a load on the tip tool being unchanged for a predetermined period of time.

The grinding tool according to the above aspect of the present disclosure may reduce wasteful power consumption and noise generation.

DETAILED DESCRIPTION

Embodiments of the present disclosure will now be described with reference to the drawings.

Figure 1:
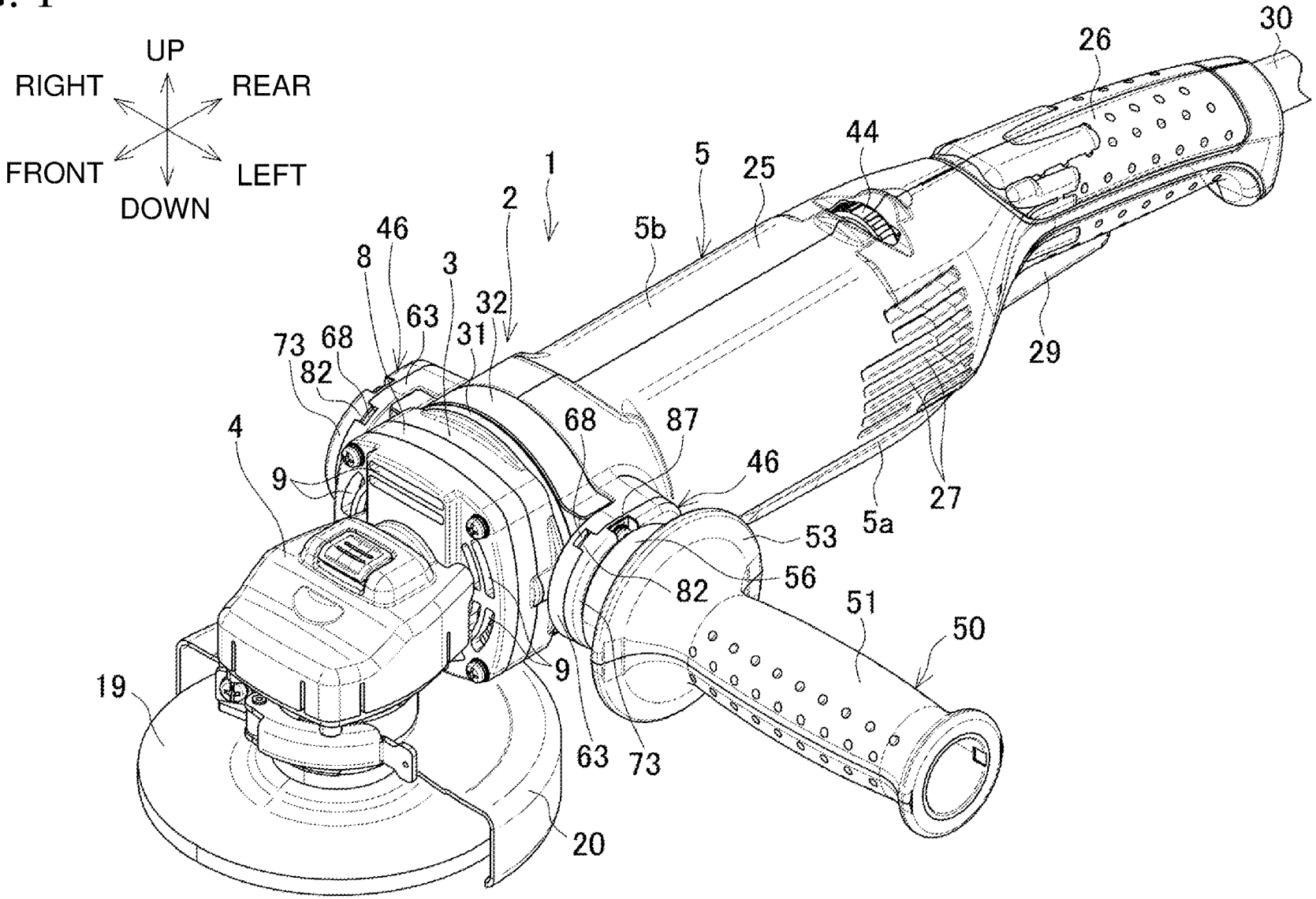
FIG. 1 is a perspective view of a grinder.
Figure 2:
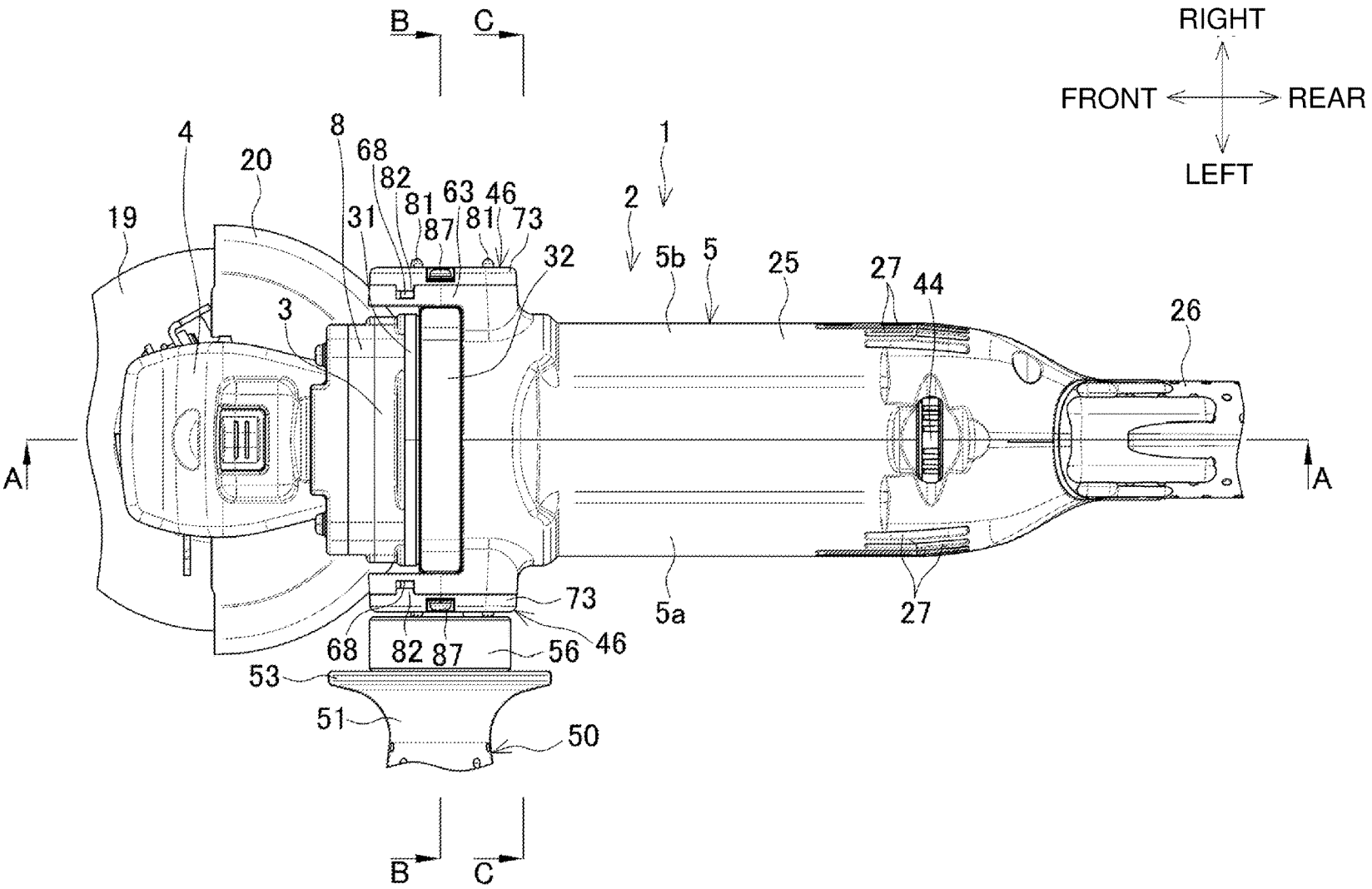
FIG. 2 is a plan view of the grinder.
Figure 3:
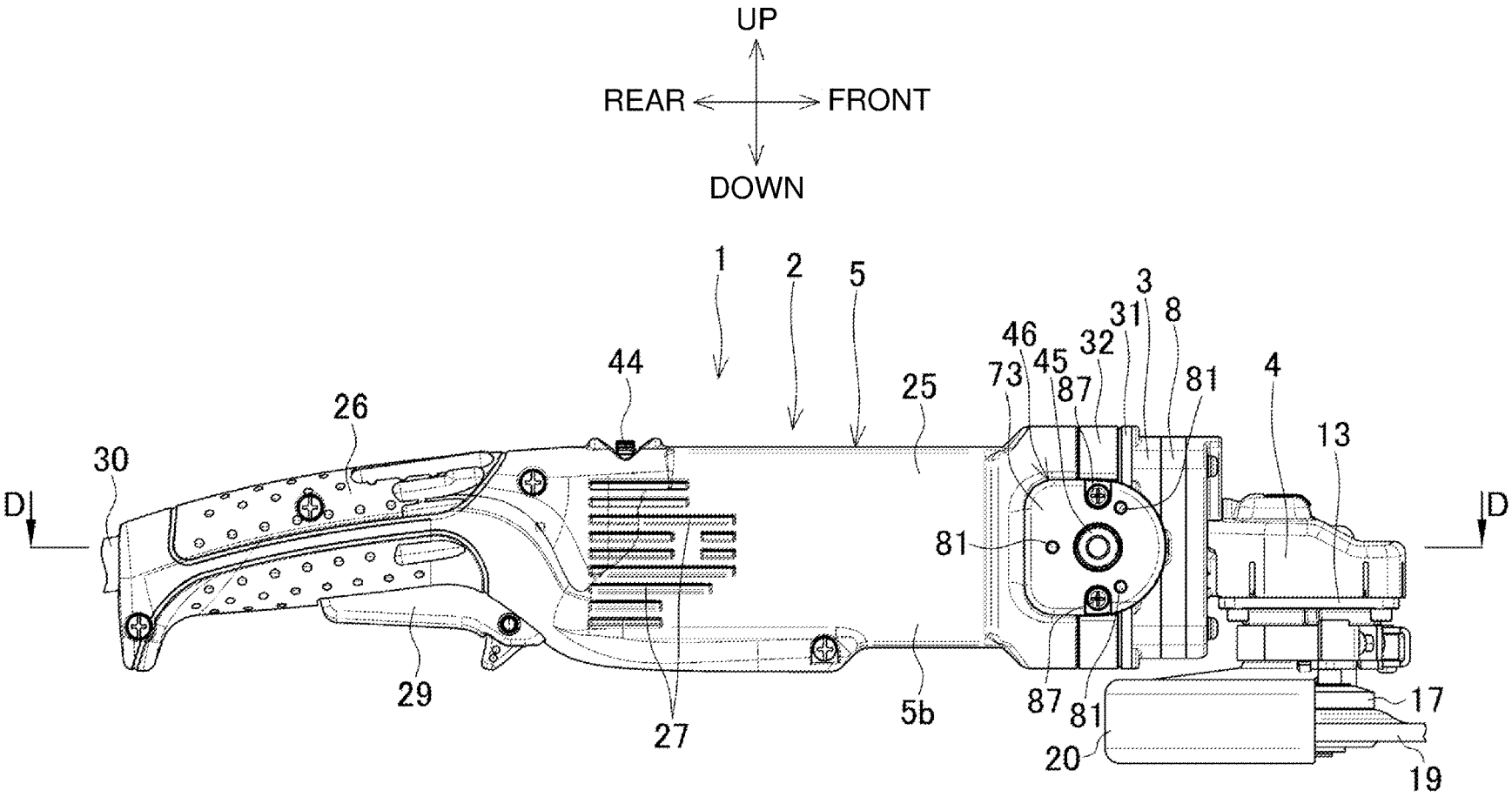
FIG. 3 is a left side view of the grinder.
Figure 4:
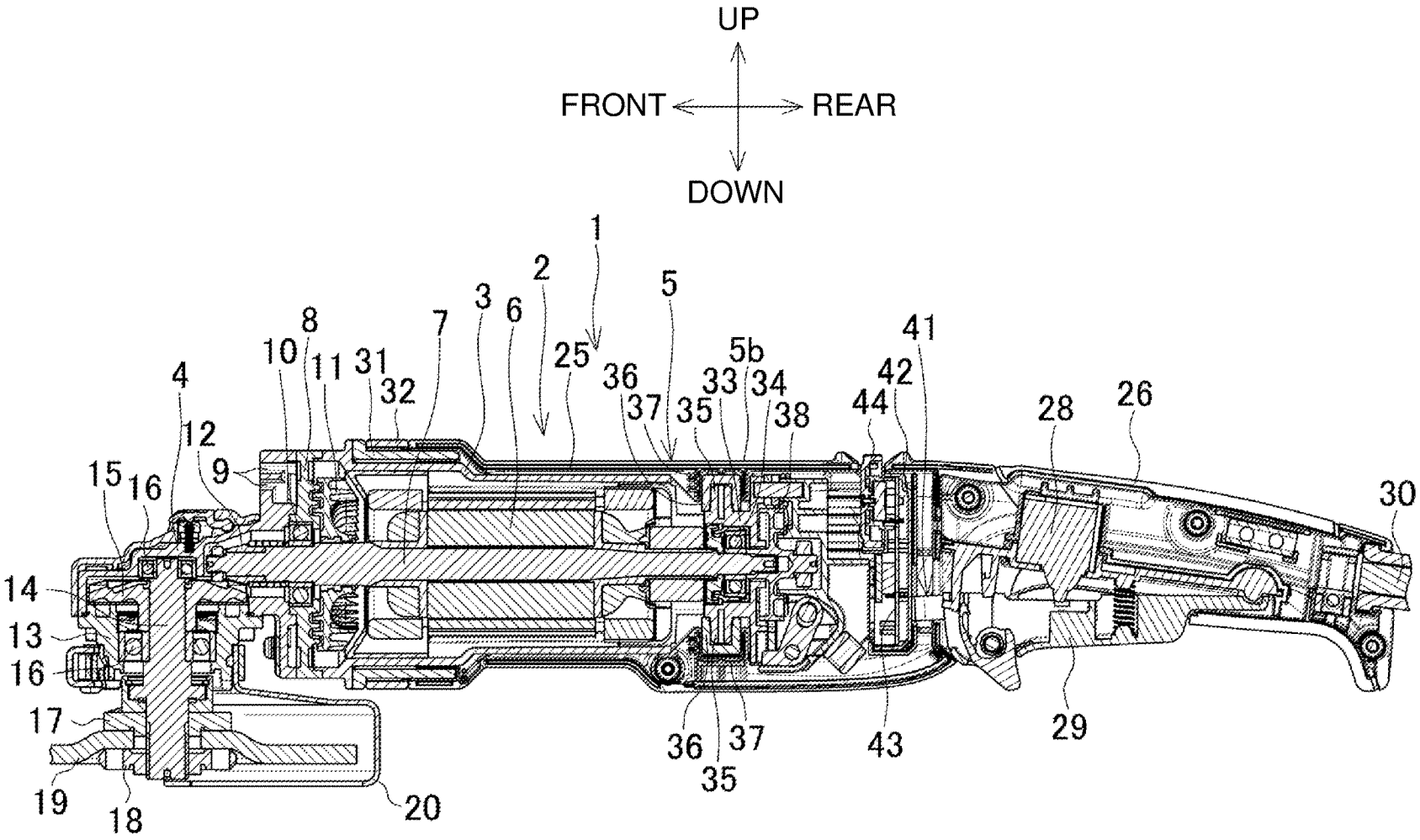
FIG. 4 is a sectional view taken along line A-A in FIG. 2.

FIG. 1 is a perspective view of a grinder as an example of a grinding tool. FIG. 2 is a plan view of the grinder. FIG. 3 is a left side view of the grinder. FIG. 4 is a sectional view taken along line A-A in FIG. 2.

A grinder 1 includes a housing 2 extending in the front-rear direction. The housing 2 includes an inner housing 3, a gear housing 4, and an outer housing 5. The inner housing 3 and the outer housing 5 are formed from a resin. The gear housing 4 is formed from a metal.

The inner housing 3 is cylindrical and accommodates a motor 6 (a commutator motor in the present embodiment). The motor 6 is held in the inner housing 3 with an output shaft 7 extending in the front-rear direction.

The gear housing 4 is fastened to the inner housing 3 with screws from the front with a gear housing cover 8 in between. The gear housing 4 has multiple outlets 9 in the front surface. Each outlet 9 connects with the inside of the inner housing 3. The output shaft 7 includes its front portion protruding into the gear housing 4 through the gear housing cover 8. The gear housing cover 8 receives a bearing 10 for supporting the output shaft 7. Behind the gear housing cover 8, a fan 11 is fixed to the output shaft 7.

A bevel gear 12 is mounted at the front end of the output shaft 7 in the gear housing 4. The gear housing 4 receives a bearing box 13 attached to its lower portion. A spindle 14 extends in the vertical direction inside the gear housing 4 and the bearing box 13. The spindle 14 receives a bevel gear 15 in its upper portion. The bevel gear 15 meshes with the bevel gear 12 on the output shaft 7.

The spindle 14 is axially supported by upper and lower bearings 16. The upper bearing 16 is held in the gear housing 4. The lower bearing 16 is held in the bearing box 13. The spindle 14 has its lower end protruding downward from the bearing box 13. The lower end of the spindle 14 can receive a tip tool 19 (e.g., a grinding disc) in a detachable manner with an inner flange 17 and a lock nut 18. A wheel cover 20 is attached to the bearing box 13. The wheel cover 20 covers a rear upper portion and a rear portion of the tip tool 19.

The outer housing 5 is cylindrical. The outer housing 5 includes a pair of left and right housing halves 5*a* and 5*b* screwed together in the lateral direction. The outer housing 5 includes a body 25 in its front portion and a main grip 26 in its rear portion. The body 25 has multiple inlets 27 in its left and right rear side surfaces. The main grip 26 has a smaller diameter than the body 25 and obliquely extends downward from a position off and above the axis of the body 25 toward the rear. The main grip 26 includes a switch 28 and a switch lever 29. The switch lever 29 is vertically swingable about its rear end as a pivot. The switch lever 29 is pushed upward to turn on the switch 28. The main grip 26 has its rear end connected to a power cable 30.

The body 25 includes a front portion coaxially holding the inner housing 3 with a rubber sleeve 31 in between. The body 25 receives a metal fixing ring 32 at its front. The fixing ring 32 is externally mounted on the rubber sleeve 31. The outer housing 5 is connected to the fixing ring 32 with extensions 63 (described later) screwed to the fixing ring 32.

Figure 6:
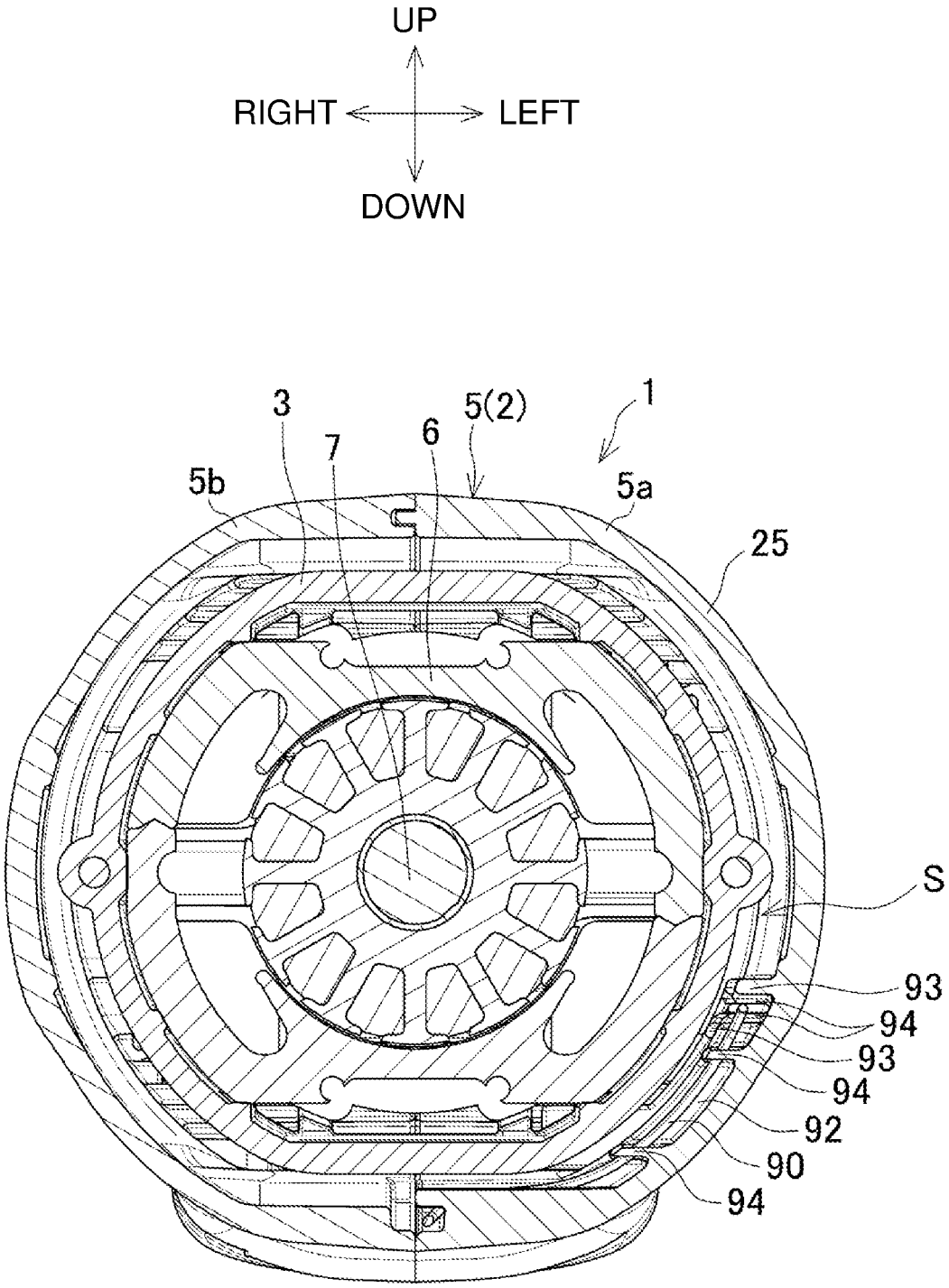
FIG. 6 is an enlarged sectional view taken along line C-C in FIG. 2.
Figure 10:
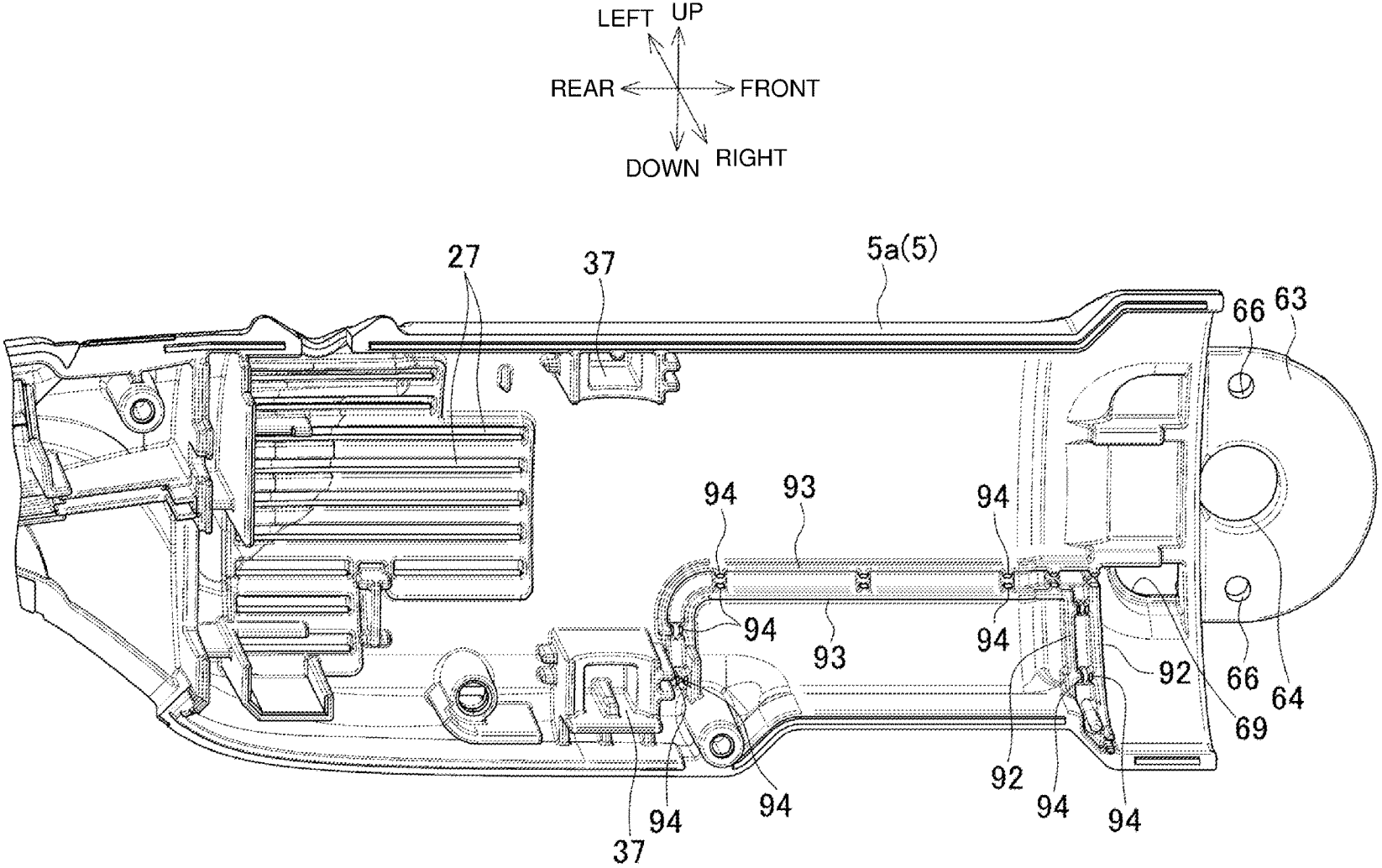
FIG. 10 is a perspective view of a left housing half.

A bearing retainer 33 is integral with a rear portion of the inner housing 3. The output shaft 7 protruding rearward from a commutator is supported by a bearing 34 held by the bearing retainer 33. The bearing retainer 33 includes a pair of upper and lower support projections 35. The support projections 35 are coaxial in the vertical direction perpendicular to the axis of the output shaft 7. Each support projection 35 receives a rubber cap 36. As also shown in FIG. 10, holders 37 are located on the upper and lower inner surfaces of the left and right housing halves 5*a* and 5*b*. The holders 37 protrude inward in the lateral direction to hold the upper and lower rubber caps 36 at the middle. Thus, the inner housing 3 is elastically supported in the outer housing 5 with the rubber sleeve 31 at the front and the rubber caps 36 at the rear. In this state, a cylindrical space S is defined between the inner housing 3 and the outer housing 5 along the entire circumference, as shown in FIG. 6.

Figure 7:
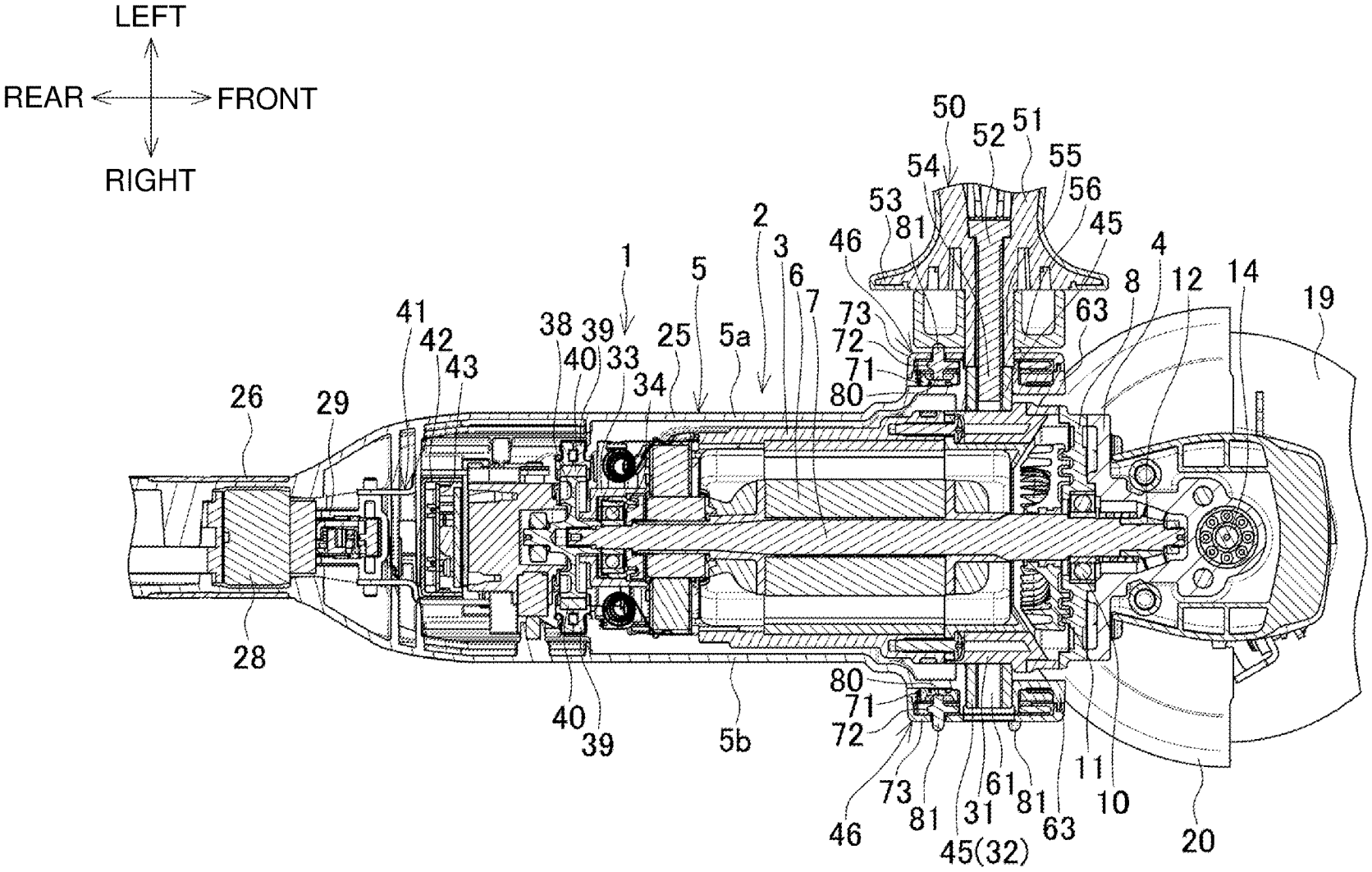
FIG. 7 is a sectional view taken along line D-D in FIG. 3.

The output shaft 7 has its rear end extending rearward through the bearing retainer 33. A brake drum 38 is fixed to the rear end of the output shaft 7. A pair of brake arms 39 are located on the left and right sides of the brake drum 38 in the body 25, as shown in FIG. 7. Each brake arm 39 is supported to be laterally swingable about its upper end as a pivot. Each brake arm 39 includes a brake shoe 40 facing the outer circumferential surface of the brake drum 38. The brake arms 39 are urged toward the brake drum 38.

The brake arms 39 operate in cooperation with a swing of the switch lever 29 with a linkage 41. At the lower limit position of the switch lever 29 at which the switch 28 is off, the brake drum 38 is pressed against the brake shoes 40 in the brake arms 39. Thus, the rotation of the brake drum 38 and the output shaft 7 is regulated. In this state, the switch lever 29 is pushed upward to turn on the switch 28. The brake arms 39 operate to open with the linkage 41 to release the pressure on the brake drum 38 applied by the brake shoes 40. This allows the brake drum 38 and the output shaft 7 to rotate.

A controller 42 is located behind the brake drum 38 in the body 25. The controller 42 is held vertically at the middle in the lateral direction. The controller 42 includes a control circuit board 43 receiving a microcomputer and a memory. An adjustment dial 44 is located on an upper front surface of the control circuit board 43. As shown in FIGS. 1 to 4, an upper portion of the adjustment dial 44 is exposed above the outer housing 5. The rotational speed of the motor 6 can be adjusted by rotating the adjustment dial 44.

The housing 2 includes, on its front left and front right, handle mounts 45 and handle attachment-gripping detectors 46 (hereafter referred to as detectors). Each handle mount 45 receives a side handle 50 in a detachable manner. Each detector 46 detects an attachment state of the side handle 50 to the handle mount 45 and a gripping state of the side handle 50. This will be described in detail below. The handle mounts 45 and the detectors 46 are symmetric to each other. The handle mount 45 and the detector 46 on the left will be described mainly.

Figure 8:
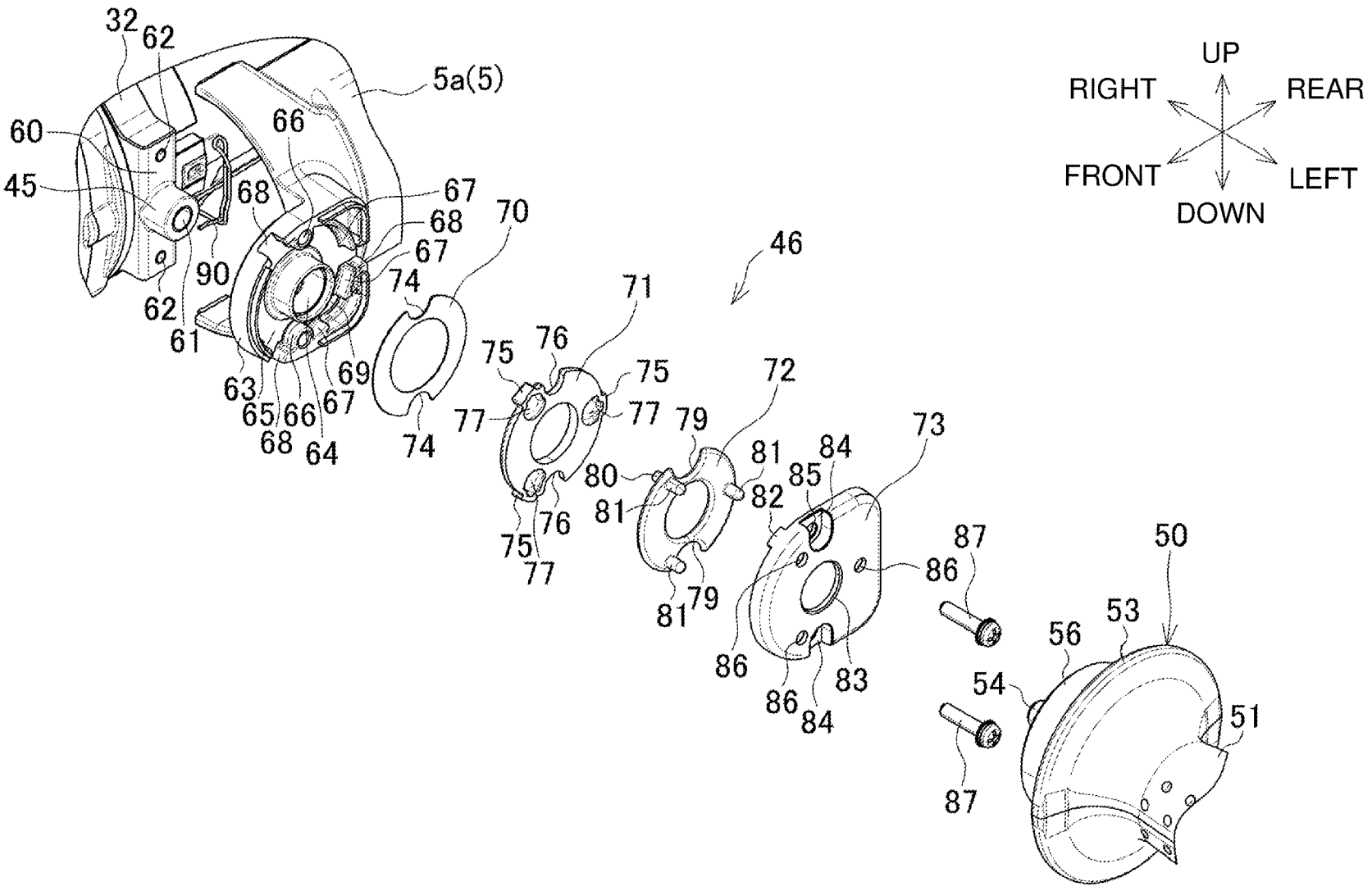
FIG. 8 is an exploded perspective view of a handle mount and a handle attachment-gripping detector as viewed from the left.
Figure 9:
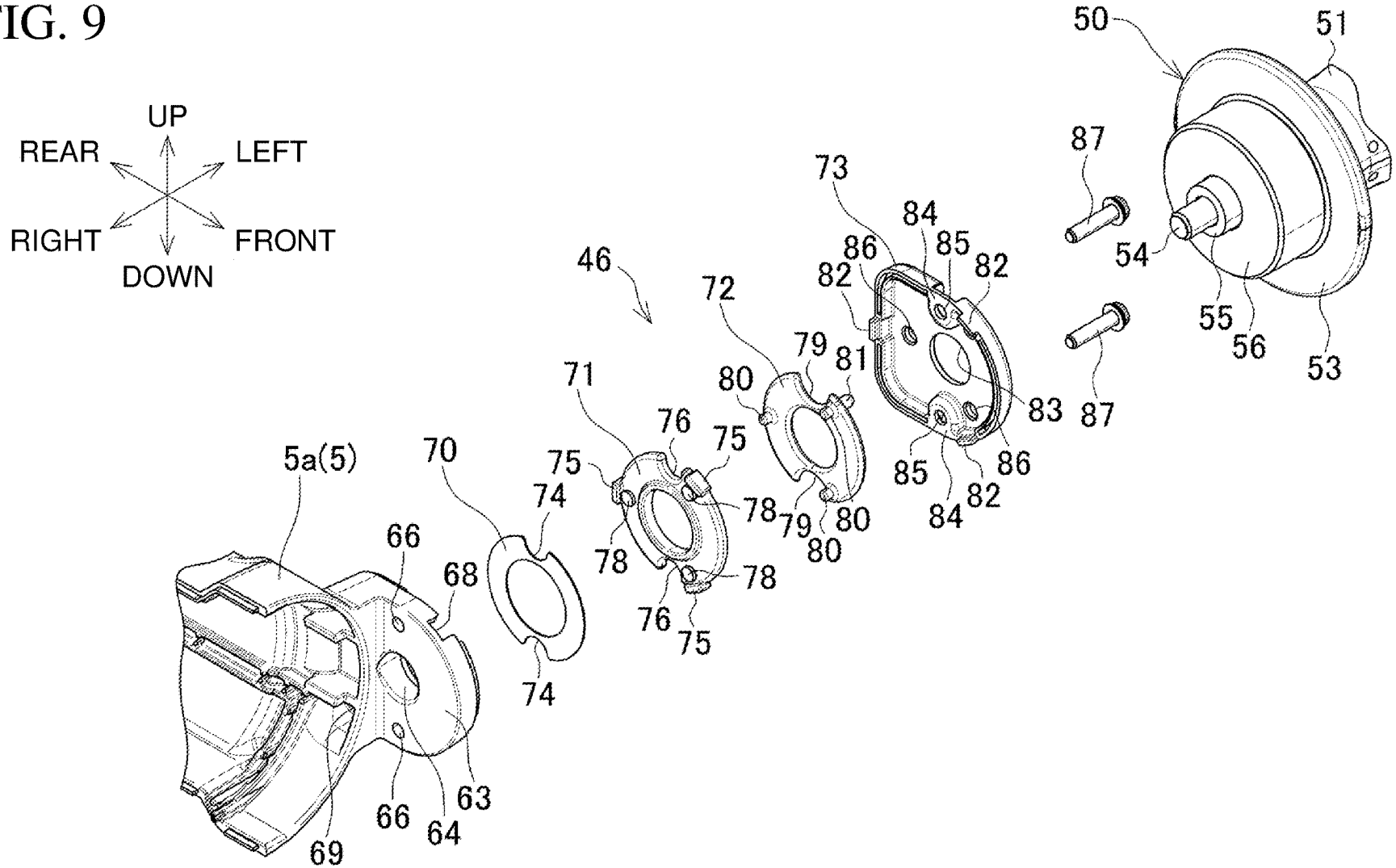
FIG. 9 is an exploded perspective view of the handle attachment-gripping detector as viewed from the right.

FIG. 8 is an exploded perspective view of the mount and the detector as viewed from the left. FIG. 9 is an exploded perspective view of the detector as viewed from the right.

Figure 5:
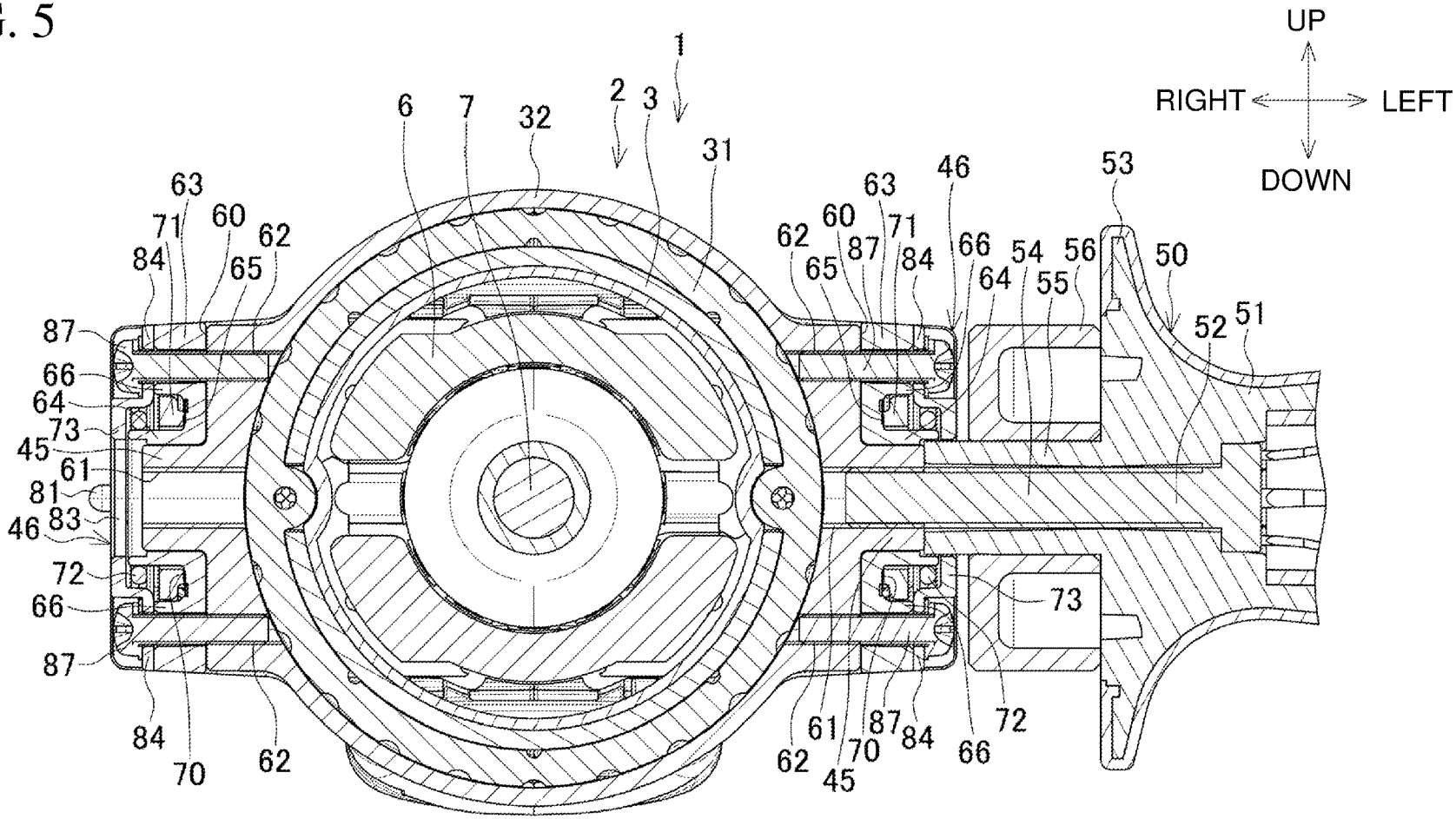
FIG. 5 is an enlarged sectional view taken along line B-B in FIG. 2.

The side handle 50 includes a grip 51 and a bolt 52, as also shown in FIG. 5. The grip 51 extends straight. The grip 51 includes a flange 53 at its end. The bolt 52 is held at the center of the grip 51 to have its threaded portion 54 protruding from the center of the flange 53. The flange 53 includes, at its center, a boss 55 covering the periphery of the threaded portion 54 except its tip. A contact plate 56 is fixed around the boss 55. The contact plate 56 is a disk coaxially surrounding the boss 55. The end face of the contact plate 56 is offset from (closer to the flange 53 than) the end face of the boss 55, exposing the tip of the boss 55.

The fixing ring 32 has receiving surfaces 60 on its left and right side surfaces. Each receiving surface 60 is a flat surface defined in the front-rear direction and in the vertical direction. The receiving surface 60 extends in the vertical direction. The handle mount 45 protrudes from the center of each receiving surface 60 in the vertical direction. The handle mount 45 is cylindrical and protrudes leftward. The handle mount 45 has, at its center, a first threaded hole 61 extending in the lateral direction. The first threaded hole 61 extends through the fixing ring 32 in the radial direction of the fixing ring 32. The side handle 50 is coaxially attached to the handle mount 45 with the threaded portion 54 of the side handle 50 screwed into the first threaded hole 61. The threaded portion 54 is screwable into the hole until the end face of the boss 55 comes in contact with the end face of the handle mount 45, as shown in FIG. 5.

The receiving surface 60 has second screw holes 62 above and below the first threaded hole 61. Each second threaded hole 62 has a smaller diameter than the first threaded hole 61. Each second threaded hole 62 is parallel to the first threaded hole 61.

With the rubber sleeve 31 placed inside the metal fixing ring 32, this structure insulates between the side handle 50 attached to the handle mount 45 and the internal components such as the motor 6.

The outer housing 5 includes the pair of left and right extensions 63 at its front end. The extensions 63 are plates extending laterally outward from the front end of the outer housing and then protruding frontward on the right and left of the receiving surfaces 60 of the fixing ring 32. A front portion of each extension 63 is semicircular in a side view. The extension 63 includes a cylindrical portion 64. The cylindrical portion 64 extends through the extension 63 in the lateral direction. The cylindrical portion 64 is located at the center of the semicircle. The left end of the cylindrical portion 64 is fittable with the boss 55 in the side handle 50.

The extension 63 includes, on the left side surface, a receiving recess 65 that is circular in a side view and is concentric with the cylindrical portion 64. The receiving recess includes small cylindrical portions 66 above and below the cylindrical portion 64. The small cylindrical portions 66 extend through the extension 63 in the lateral direction. Each small cylindrical portion 66 is coaxially located leftward and outward from the corresponding second threaded hole 62 in the receiving surface 60 of the fixing ring 32. The receiving recess includes three ribs 67 on the circumference behind the cylindrical portion 64. The ribs 67 are arc-shaped and are located circumferentially at intervals along the same circle centered at the cylindrical portion 64. The extension 63 has cutouts 68 at two positions in the vertical direction of the front portion and at the center in the vertical direction of its rear portion. A wiring hole 69 is located outside the ribs 67 and at the lower rear of the extension 63. The wiring hole 69 extends in the lateral direction.

The detector 46 is located on the extension 63. The detector 46 includes a pressure sensor 70, a pressure rubber 71, a movable plate 72, and an outer cover 73.

The pressure sensor 70 is a sheet with a resistance value changing with a load applied in the thickness direction. The pressure sensor 70 is annular in a side view. The cylindrical portion 64 extends through the center of the pressure sensor 70. The pressure sensor 70 is located at the bottom of the receiving recess 65. The pressure sensor 70 has cutouts 74 in the upper and lower circumferences. The cutouts 74 avoid interference with the small cylindrical portions 66. A first wire 90 is electrically connected to the pressure sensor 70. The first wire 90 extends from inside the outer housing 5 through the wiring hole 69 and outside the extension 63 to the left.

The pressure rubber 71 overlaps the pressure sensor 70 from the left inside the ribs 67. The pressure rubber 71 is a disk through which the cylindrical portion 64 extends. The pressure rubber 71 includes three tabs 75 on the circumference. Each tab 75 engages with the corresponding cutout 68 in the extension 63 from inside. The pressure rubber 71 has semicircular inner cutouts 76 in the upper and lower circumferences. The inner cutouts 76 avoid interference with the small cylindrical portions 66. The pressure rubber 71 has recesses 77 radially inward from the corresponding tabs 75 on the left side surface. Multiple recesses 77 are located at equal intervals in the circumferential direction of the pressure rubber 71. The pressure rubber 71 includes, on the right side surface, protrusions 78 at the back of the recesses 77.

The movable plate 72 is located inside the ribs 67 and leftward and outward from the pressure rubber 71. The movable plate 72 is a disk. The cylindrical portion 64 extends through the movable plate 72. The movable plate 72 has semicircular outer cutouts 79 in the upper and lower circumferences. The outer cutouts 79 avoid interference with the small cylindrical portions 66. The movable plate 72 includes, on both the left and right side surfaces, inner pins 80 and outer pins 81 coaxial with each other. Multiple inner pins 80 and multiple outer pins 81 are located at equal intervals in the circumferential direction. Each inner pin 80 is located outside the corresponding recess 77 on the pressure rubber 71.

The outer cover 73 has the same shape as the extension 63 in a side view. The outer cover 73 includes engaging projections 82 on the right side surface of its front portion and rear end. The engaging projections 82 are aligned with the corresponding cutouts 68 in the extension 63. The outer cover 73 has a round hole 83 in the front portion. The round hole 83 is at the left of and is coaxial with the cylindrical portion 64 of the extension 63. The round hole 83 receives the boss 55 on the side handle 50. A pair of receiving seats 84 are recessed above and below the round hole 83. Each receiving seat 84 has a through-hole 85. Each through-hole 85 is at the left of and is coaxial with the corresponding small cylindrical portion 66 of the extension 63. The outer cover 73 has three small holes 86. Each outer pin 81 on the movable plate 72 extends through the corresponding small hole 86.

The pressure sensor 70, the pressure rubber 71, and the movable plate 72 in the detector 46 are installed in the receiving recess 65 in this order. The outer cover 73 then covers these components from the outermost position, and two screws 87 extend through the through-holes 85 and the small cylindrical portions 66 of the extension 63 from left outside to be screwed into the second threaded holes 62 in the receiving surface 60. The handle mount 45 is thus integrally fixed to the extension 63 on the outer housing 5.

The pressure sensor 70 is then locked in a nonrotatable manner at the bottom of the receiving recess 65 with the engagement between the small cylindrical portions 66 and the cutouts 74. The pressure rubber 71 is locked in the receiving recess 65 in a nonrotatable manner with the engagement between the small cylindrical portions 66 and the inner cutouts 76 and the engagement between the tabs 75 and the cutouts 68. This places the protrusions 78 into contact with the pressure sensor 70. The movable plate 72 is accommodated between the pressure rubber 71 and the outer cover 73 in a movable manner in the lateral direction. With each inner pin 80 in contact with the corresponding recess 77 on the pressure rubber 71, the movable plate 72 is urged to the outermost position at which each outer pin 81 protrudes outward through the corresponding small hole 86 in the outer cover 73 with the elasticity of the pressure rubber 71, as in the right detector 46 in FIG. 7.

Figure 11:
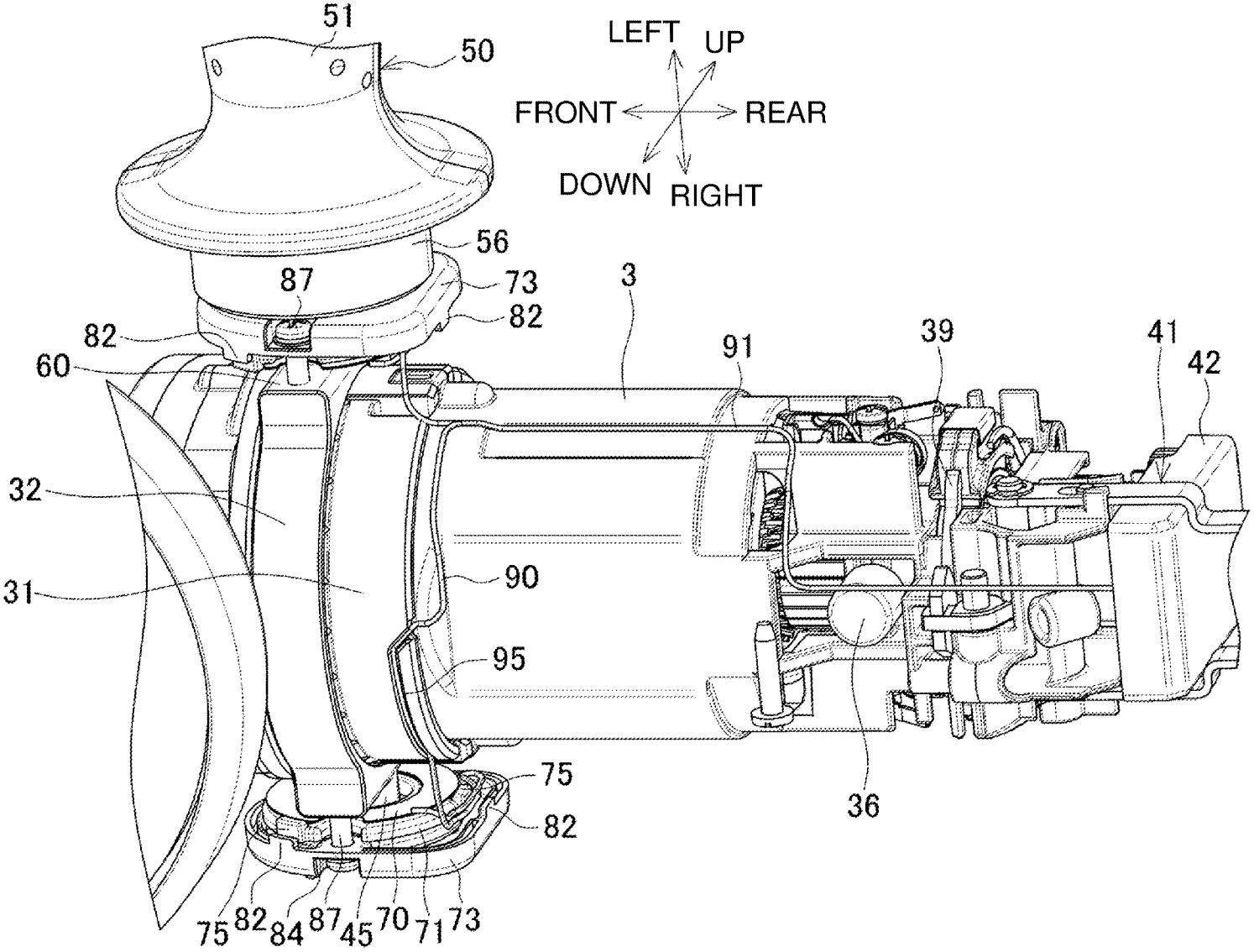
FIG. 11 is a perspective view of the grinder without showing an outer housing as viewed from below.
Figure 12:
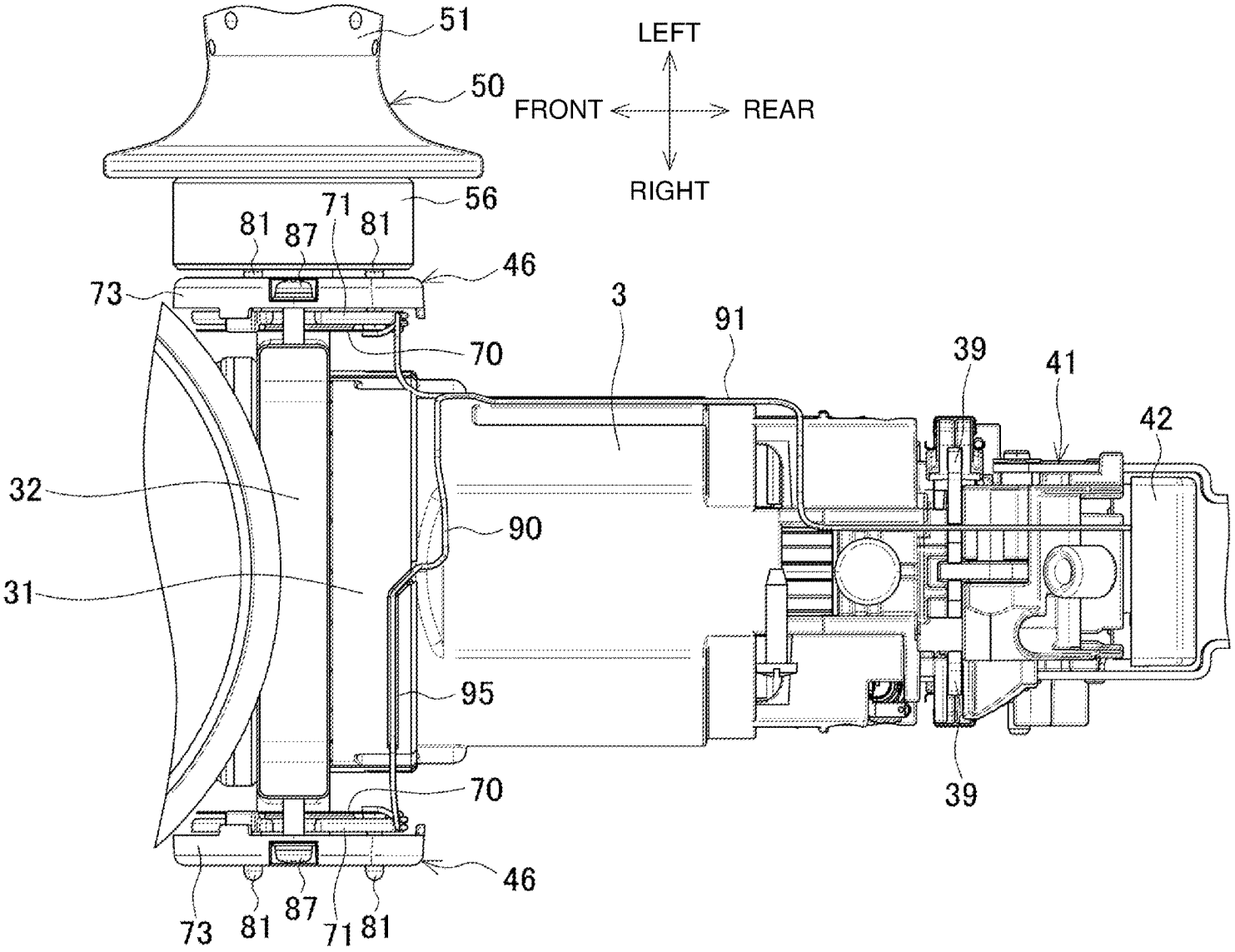
FIG. 12 is a bottom view of the grinder without showing the outer housing.

The pressure sensors 70 are electrically connected to the control circuit board 43 in the controller 42. As shown in FIGS. 11 and 12, the left and right pressure sensors 70 are electrically connected to each other with the first wire 90 including multiple signal lines. A second wire 91 including multiple signal lines is electrically connected to the first wire 90. The second wire 91 is connected to the control circuit board 43.

The first wire 90 and the second wire 91 are routed in the cylindrical space S between the inner housing 3 and the outer housing 5.

In the cylindrical space S, a pair of parallel first ridges 92 protrude on the front inner surface of the left housing half 5*a*, as shown in FIGS. 6 and 10. The first ridges 92 each have the upper end behind the wiring hole 69 in the left extension 63 and extend in the circumferential direction of the housing half 5*a* to the lower end of the housing half 5*a*.

A pair of parallel second ridges 93 protrude on the inner surface of the housing half 5*a*. The second ridges 93 each rise in the circumferential direction from near the lower inner surface of the housing half 5*a* in front of the holder 37 holding the rubber cap 36 and then extend frontward in the axial direction to connect with the upper ends of the first ridges 92 behind the wiring hole 69 in the left extension 63. The ridges 92 and 93 include, at predetermined intervals in their elongated directions, multiple projections 94 protruding toward the ridges 92 and 93. Each projection 94 faces the corresponding projection 94.

The rubber sleeve 31 has a guide groove 95 on the right lower surface of its right portion. The guide groove 95 slopes from the rear end at the middle in the lateral direction to the front right and then extends to the right in the circumferential direction.

The two ends of the first wire 90 are drawn out through the wiring holes 69 in the left and right extensions 63 to the left and right of the extensions 63 and are electrically connected to the pressure sensors 70 in the receiving recesses 65. A middle portion of the first wire 90 is held in the cylindrical space S with its right portion fitted in the guide groove 95 on the rubber sleeve 31 and its left portion held between the first ridges 92 on the housing half 5*a*.

The second wire 91 drawn from the control circuit board 43 is routed frontward along the second ridges 93 while being held between the second ridges 93 in the cylindrical space S. The second wire 91 is then connected to the first wire 90 behind the left wiring hole 69.

Figure 13:
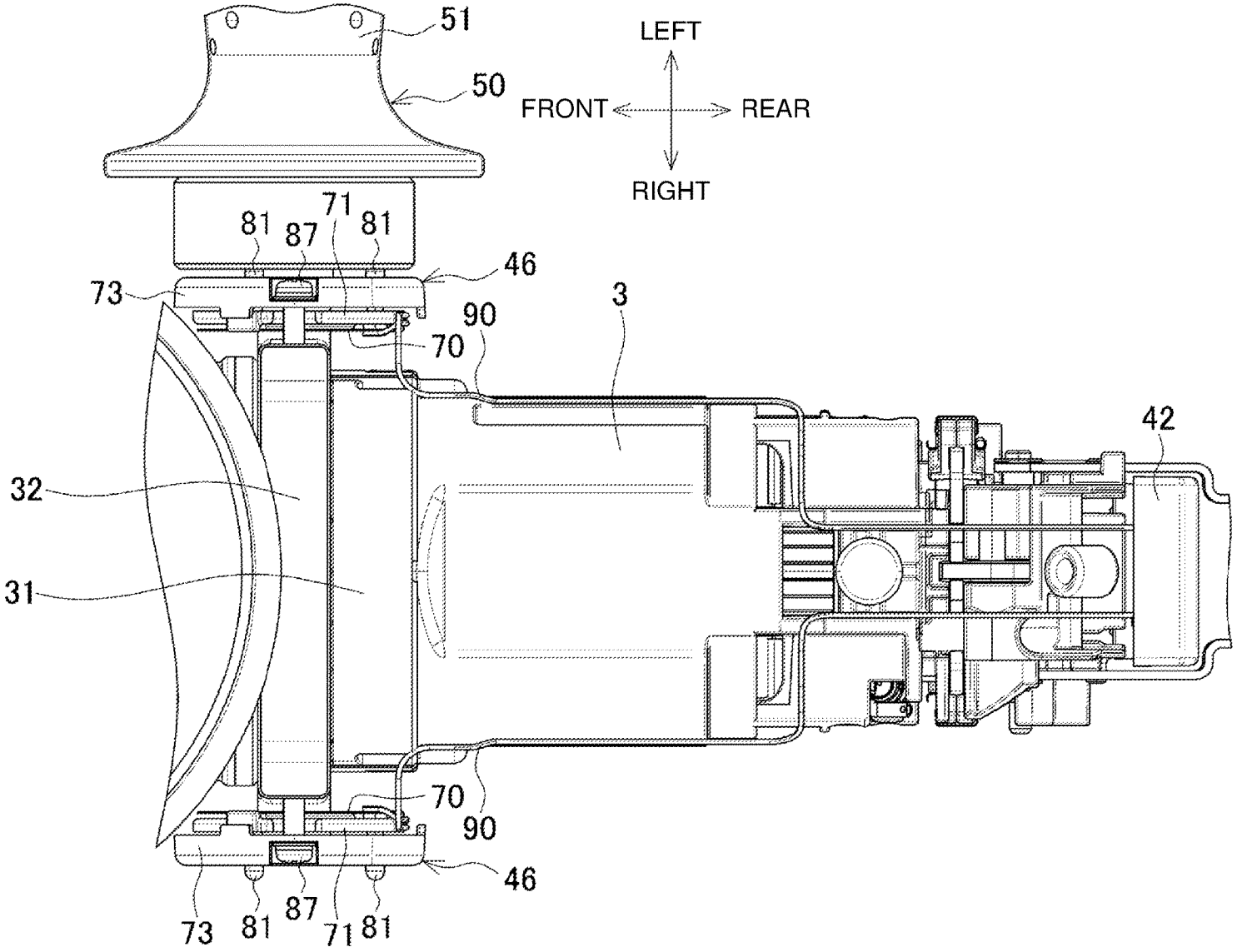
FIG. 13 is a bottom view of a grinder with wiring in a modification, without showing an outer housing.

The wiring structure is not limited to this. As shown in FIG. 13, for example, first wires 90 may be connected to each of the pressure sensors 70 in the left and right detectors 46 and be routed rearward to be connected directly to the controller 42.

Thus, the detectors 46 are connected to the controller 42 with the separate first wires 90 each for one of the detectors 46. With this structure, when one of the wires 90 is, for example, disconnected, the controller 42 determines that the handle is attached to neither detectors 46 despite the other wire 90 remains connected.

In this case, the right housing half 5*b* may also include the second ridges 93 to guide the wires 90.

Figure 14:
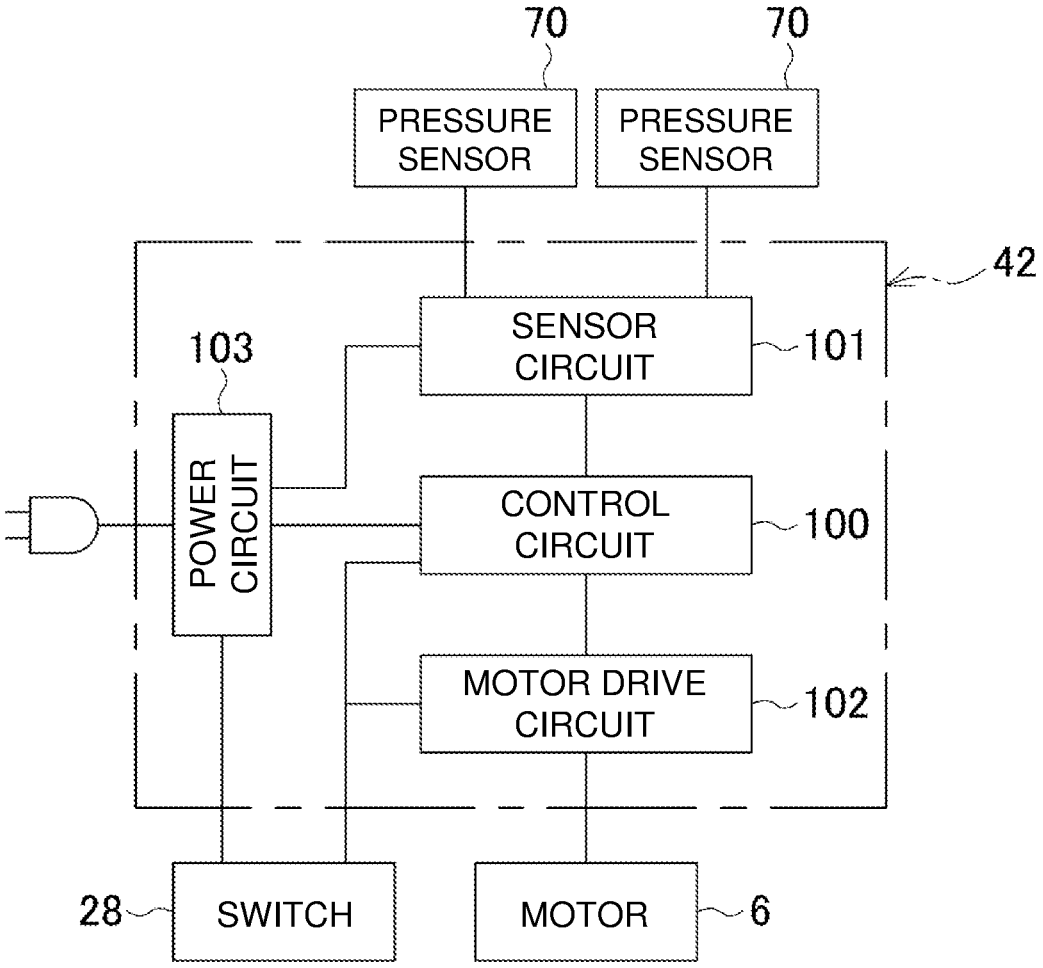
FIG. 14 is a functional block diagram of a controller.
Figure 15:
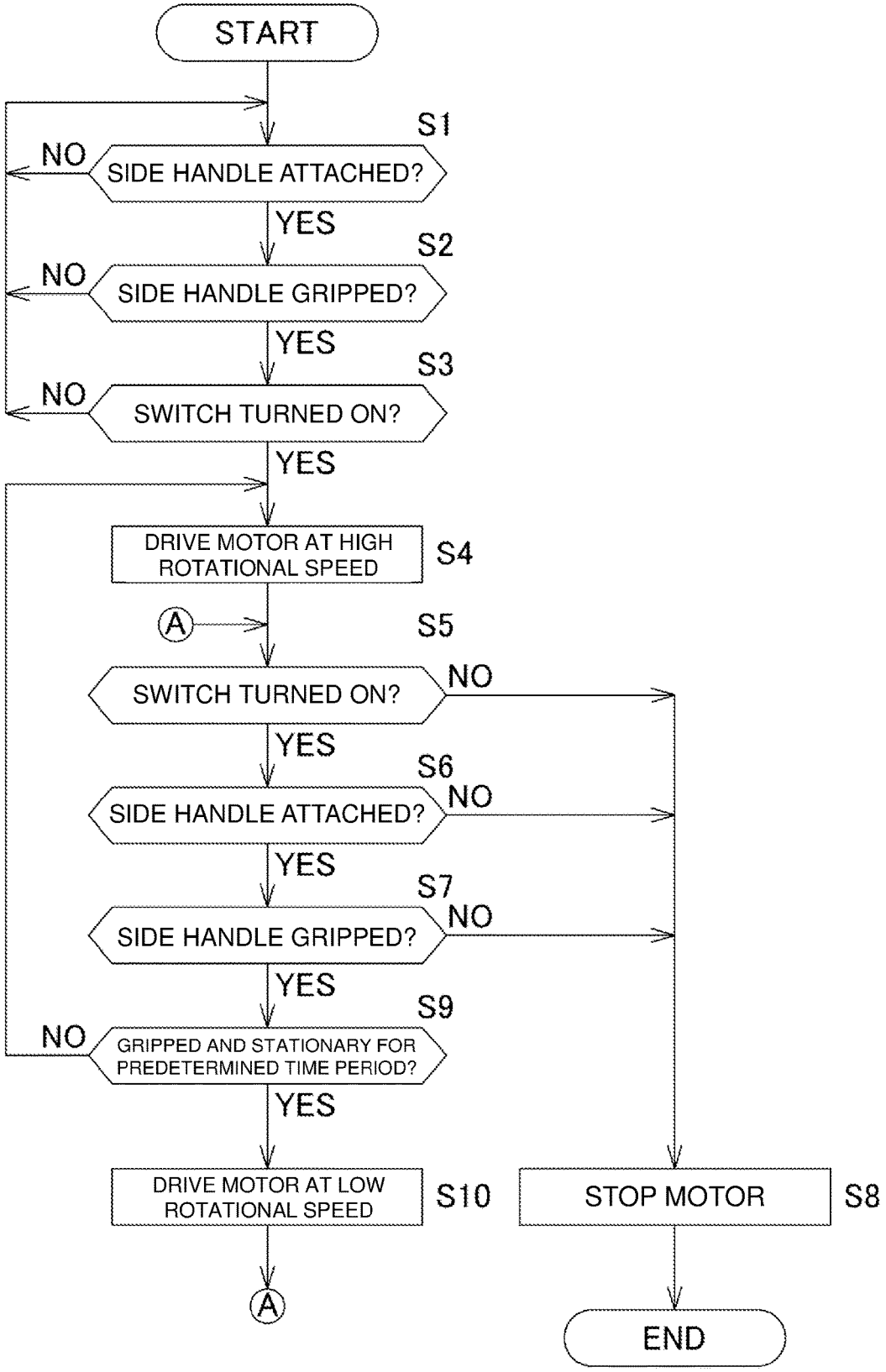
FIG. 15 is a flowchart of motor control.

FIG. 14 is a functional block diagram of the controller 42. The controller 42 includes a control circuit 100, a sensor circuit 101, a motor drive circuit 102, and a power circuit 103. The control circuit 100 includes a microcontroller or a similar device on the control circuit board 43. The sensor circuit 101 outputs resistance values obtained from the left and right pressure sensors 70 to the control circuit 100 as load detection signals. The control circuit 100 controls driving of the motor 6 through the motor drive circuit 102 based on a load detection signal from the sensor circuit 101 and an on or off signal from the switch 28. The power circuit 103 generates operating power from utility power supplied through the power cable 30 and supplies the operating power to each circuit. The drive control over the motor 6 performed by the control circuit 100 will now be described with reference to a flowchart shown in FIG. 15.

When power is supplied through the power cable 30, the control circuit 100 determines whether the side handle 50 is attached to at least the left handle mount 45 or the right handle mount 45 in step S1.

This determination is performed based on whether the resistance value of the pressure sensor 70 in each of the left and right detectors 46 exceeds a predetermined first threshold through the first wire 90 and the second wire 91. More specifically, when the threaded portion 54 of the side handle 50 is screwed into either the left or right handle mount 45, the boss 55 comes in contact with the handle mount 45. In this state, a clearance smaller than the protruding amount of each outer pin 81 from the outer cover 73 is left between the left or right side surface of the outer cover 73 and the end face of the contact plate 56 in the side handle 50. Thus, each outer pin 81 in contact with the end face of the contact plate 56 is pressed. The movable plate 72 then moves laterally inward.

Each inner pin 80 on the movable plate 72 presses the corresponding recess 77 on the pressure rubber 71. Thus, each protrusion 78 on the back of the corresponding recess 77 presses the pressure sensor 70. This changes the resistance value. The resulting value is then input from the sensor circuit 101 into the control circuit 100 as a load detection signal. The control circuit 100 determines that the side handle 50 has been attached in response to the input resistance value exceeding the first threshold (Yes in step S1).

Without the side handle 50 attached to the left or right handle mount 45 (No in step S1), the resistance values of the pressure sensors 70 thus do not exceed the first threshold. When the switch lever 29 is pushed in and the switch 28 is turned on in this state, the control circuit 100 does not drive the motor 6.

In step S2, the control circuit 100 determines whether the side handle 50 attached is gripped by the operator.

This determination is performed based on whether the resistance value of the pressure sensor 70 in the detector 46 with the side handle 50 attached exceeds a predetermined second threshold. The second threshold is greater than the first threshold. When the side handle 50 is gripped, the side handle 50 tilts relative to the handle mount 45, increasing the load on the pressure sensor 70 and increasing the resistance value.

When the resistance value of the pressure sensor 70 exceeds the second threshold, the control circuit 100 determines that the side handle 50 is gripped (Yes in step S2). When the resistance value of the pressure sensor 70 does not exceed the second threshold, the control circuit 100 determines that the side handle 50 is not gripped (No in step S2). Thus, when the switch lever 29 is pushed in and the switch 28 is turned on in this state, the control circuit 100 does not drive the motor 6.

When the switch lever 29 is pushed in and the switch 28 is turned on in step S3 (Yes in step S3) with the attached side handle 50 gripped, the control circuit 100 supplies drive power to the motor 6 in step S4 at a predetermined high rotational speed (e.g., 9000 revolutions/minute) to rotate the motor 6. With the switch lever 29 being pushed in to release braking on the brake drum 38, the output shaft 7 rotates together with the brake drum 38. The rotation of the output shaft 7 is transmitted to the spindle 14 through the bevel gears 12 and 15. This causes the tip tool 19 to rotate. The operator grips the main grip 26 with one hand and the grip 51 in the side handle 50 with the other hand to, for example, grind the workpiece with the tip tool 19.

During operation, the control circuit 100 constantly monitors the on state of the switch 28 in step S5, the attachment state of the side handle 50 in step S6, and the gripping state of the side handle 50 in step S7. When any of the conditions is not satisfied (No in any of steps S5 to S7), the control circuit 100 stops the motor 6 in step S8. The motor 6 is stopped by releasing the switch lever 29 being pushed, detaching the side handle 50, or removing the hand from the side handle 50.

In step S9, the control circuit 100 monitors a load current (torque) to the motor 6, with the side handle 50 being gripped. When the load current does not vary for a predetermined period of time (e.g., 2 to 10 seconds) (Yes in step S9), no operation is being performed, or specifically, the side handle 50 is gripped and is stationary. In step S10, the rotational speed of the motor 6 is lowered to a predetermined low rotational speed (e.g., 4000 to 5000 revolutions/minute). When the load current varies within the predetermined period of time during operation (No in step S9), the processing returns to step S4 to maintain the high rotational speed.

After the rotational speed is set to the low rotational speed in step S10, the load current of the motor 6 can vary when, for example, the grinder 1 is shaken, its orientation is changed, or an operation such as grinding is resumed, with the side handle 50 being gripped and the switch 28 being on. The control circuit 100 detecting such a change then determines that the side handle 50 is not gripped and is not stationary (No in step S9). The processing then returns to step S4 to restore the high rotational speed of the motor 6.

Thus, the grinder 1 according to the embodiment includes the housing 2, the spindle 14, the switch 28, and the controller 42. The housing 2 accommodates the motor 6. The spindle 14 protrudes from the housing 2 and is rotatable upon being driven by the motor 6. The spindle 14 has an end to receive the tip tool 19. The switch 28 is turned on or off in response to an external operation. The controller 42 controls driving of the motor 6 in response to the switch 28 being turned on or off. The grinder 1 also includes the handle mount on the housing 2 to receive the side handle 50 (auxiliary handle) in a detachable manner, the detector 46 (handle detector) that electrically detects the attachment state of the side handle 50 to the handle mount 45, and the detector 46 (handle gripping detector) that electrically detects the gripping state of the side handle 50 attached to the handle mount 45. The controller 42 drives the motor 6 in response to the switch 28 being turned on after the detector 46 detects attachment of the side handle 50 and the detector 46 detects gripping of the side handle 50. The controller 42 controls the motor 6 to rotate at a predetermined high rotational speed (first rotational speed) in response to the switch 28 being turned on with the attachment and the gripping of the side handle 50 being detected. The controller 42 controls the motor 6 to rotate at a predetermined low rotational speed (second rotational speed) in response to the state of a load on the tip tool 19 being unchanged for a predetermined period of time.

This controls the motor 6 at a low rotational speed when no operation is performed or when the tip tool 19 is out of contact with the workpiece. This reduces wasteful power consumption and noise generation. The second rotational speed may be 0 revolutions/minute.

In some embodiments, the second rotational speed is other than 0 revolutions/minute.

The tip tool 19 rotates when no operation is performed. The operation can be resumed in a short time. This can reduce any decrease in the operational efficiency.

The handle detector 46 detects attachment and gripping of the handle using the pressure sensor 70 (sensor) as a common sensor.

The handle detector and the handle gripping detector can be reasonably space-saving to reduce any cost increase.

The state of the load on the tip tool 19 includes a load current from the motor 6.

Thus, the state of the load can be easily determined based on the load current.

The controller 42 controls the motor 6 to rotate at the high rotational speed in response to the controller 42 detecting a change in the state of the load during control of the motor 6 at the low rotational speed.

Thus, when the operation is resumed, the motor 6 automatically returns to the high rotational speed in a short time. The rotational speed of the motor 6 lowered in a no-load state does not decrease the operational efficiency or does not decrease the ease of use.

The grinder 1 includes multiple (e.g., two) handle mounts 45.

Thus, the side handle 50 can be attached at a position selected for easy operation.

Modifications of the present disclosure will now be described.

Figure 16:
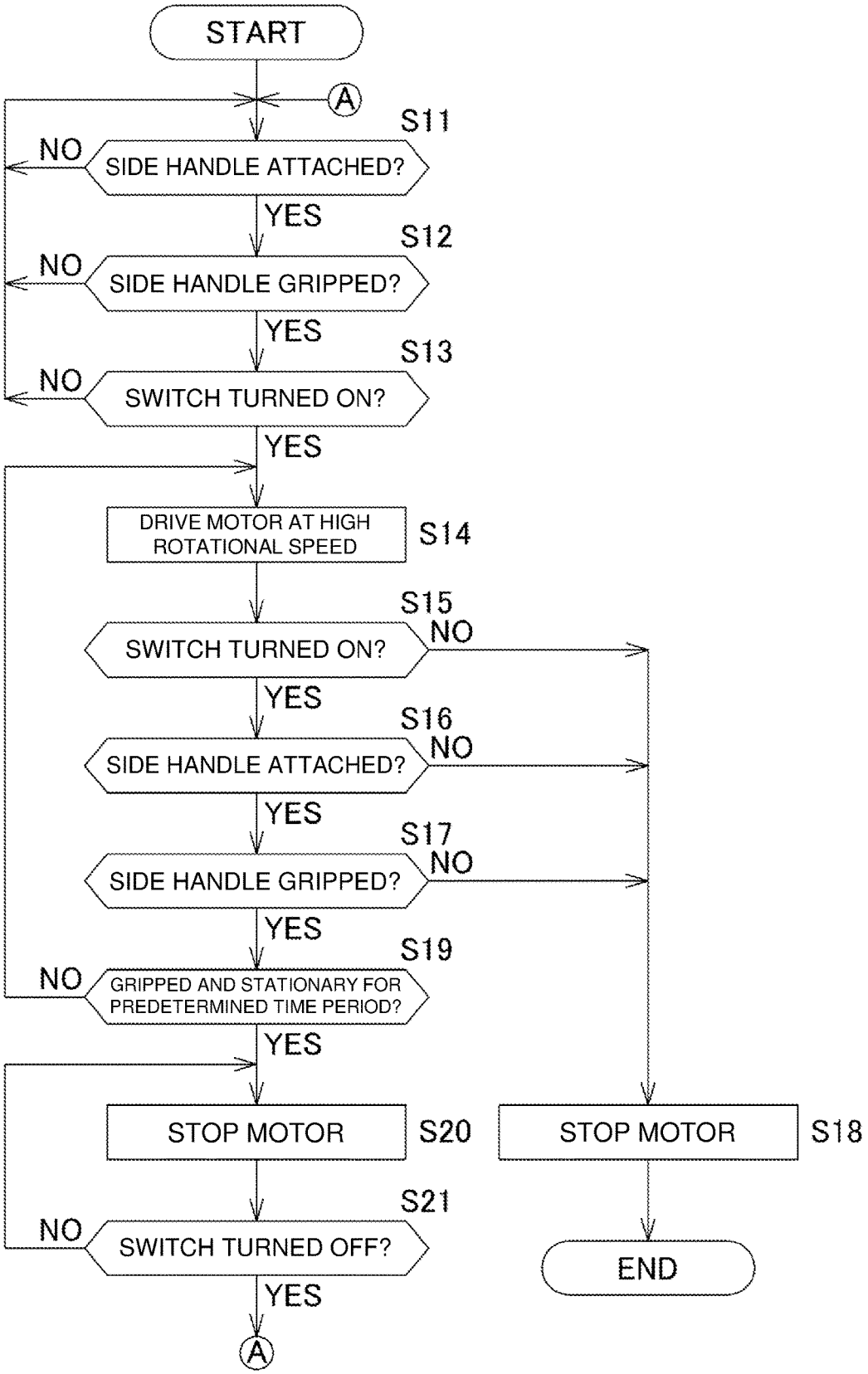
FIG. 16 is a flowchart of motor control in a modification.

In the above embodiment, the motor is controlled to rotate at a low rotational speed when the no-load state continues for a predetermined period of time. In some embodiments, the motor may be stopped without being controlled to rotate at the low rotational speed. The control will now be described with reference to a flowchart shown in FIG. 16.

The processing in steps S11 to S19 is the same as in steps S1 to S9 in the embodiment. However, when the load current does not change in step S19 for the predetermined period of time (Yes in step S19), the control circuit 100 is not operating, or specifically, the side handle 50 is gripped and is stationary. In this case, the motor 6 is stopped in step S20.

In step S21, the determination is performed as to whether the switch 28 is turned off by releasing the switch lever 29. When the switch 28 is turned off, the stop control over the motor 6 is reset. The processing thus returns to step S11. Thus, when the side handle 50 attached is detected in step S11 and the side handle 50 gripped is detected in step S12, the switch lever 29 is pushed in. When the switch 28 turned on is detected in step S13, the control circuit 100 controls the motor 6 to rotate at the high rotational speed in step S14. When the switch 28 being off is not detected in step S21, the stop control over the motor 6 is maintained.

Thus, the controller 42 in the modification controls the motor 6 at a rotational speed of 0 revolutions/minute under the state of the load on the tip tool 19 unchanged for the predetermined period of time, and then resets the control over the motor 6 at the rotational speed of 0 revolutions/minute when the switch 28 is turned off. When the switch 28 is turned on with the side handle 50 attached and gripped being detected subsequently, the motor 6 is controlled to rotate at the high rotational speed.

The motor 6 is stopped in the no-load state to reliably eliminate wasteful power consumption and noise generation. When the switch 28 is turned off, the stop control over the motor 6 is reset. The system can thus automatically return to normal use.

The detector may include any pressure sensor other than the single sheet pressure sensor described in the embodiment. For example, the detector may include an independent pressure sensor for each inner pin on the movable plate. In this case, the side handle being attached may be determined when the resistance values of one or more (e.g., two), but not all, of the pressure sensors exceed the first threshold. Similarly, the side handle being gripped may be determined when the resistance values of one or more (e.g., two) of the pressure sensors exceed the second threshold. More or fewer inner pins and pressure sensors may be used as appropriate.

The detector may not include the pressure sensor. As described in Patent Literature 1, for example, the detector may be a unit including a detection plate with the position changeable in response to the attachment of the side handle and a photo interrupter that detects the position of the detection plate. Other structures may be used.

In the embodiment and modifications, the attachment and the gripping of the side handle can be detected using the single detector. In some embodiments, a side handle attachment detector and a side handle gripping detector may be separate detectors. These detectors may have the same structure or may have different structures.

The handle mount is not limited to indirect attachment to the outer housing with the fixing ring as in the embodiment. The handle mount may be directly attached to the outer housing or the gear housing. The auxiliary handle is also not limited to the side handle in the embodiment. The shape of the grip may be changed as appropriate. The auxiliary handle may be connected with a structure other than the screwing.

The structures of the inner housing and the outer housing are also not limited to the structures in the embodiment. For example, the outer housing may not be halved. The inner housing may be halved.

The elastic support of the inner housing with the outer housing is also not limited to the structure in the embodiment. For example, the length of the rubber sleeve may be changed, or multiple short rubber rings may be located in the axial direction. The elastic support may be eliminated.

The grinder may be a direct current (DC) tool powered by a battery pack mountable on the battery mount in the housing, rather than an alternating current (AC) tool powered by utility power. This structure eliminates routing of the power cable, increasing operability and workability.

The motor may be a brushless motor.

The grinding tool according to the present disclosure is not limited to the grinder. For example, the present disclosure is applicable to other grinding and polishing tools such as polishers and sanders. Thus, the handle mounts are not limited to a pair of left and right handle mounts. The handle mount may be either the left or right handle mount, or three or more handle mounts may be used.

REFERENCE SIGNS LIST

1 grinder
2 housing
3 inner housing
4 gear housing
5 outer housing
6 motor
7 output shaft
14 spindle
19 tip tool
25 body
26 main grip
28 switch
29 switch lever
42 controller
43 control circuit board
45 handle mount
46 handle attachment-gripping detector
50 side handle
51 grip
52 bolt
54 threaded portion
60 receiving surface
61 first threaded hole
63 extension
65 receiving recess
69 wiring hole
70 pressure sensor
71 pressure rubber
72 movable plate
73 outer cover
77 recess
78 protrusion
80 inner pin
81 outer pin
87 screw
90 first wire
91 second wire
92 first ridge
93 second ridge
95 guide groove
100 control circuit
101 sensor circuit
102 motor drive circuit
103 power circuit

What is claimed is:

1. A grinding tool, comprising:

a housing accommodating a motor;

a spindle protruding from the housing and being rotatable upon being driven by the motor, the spindle having an end to receive a tip tool;

a switch to be turned on or off in response to an external operation;

a controller configured to control driving of the motor in response to the switch being turned on or off;

a handle mount on the housing to receive an auxiliary handle in a detachable manner;

a handle detector configured to electrically detect an attachment state of the auxiliary handle to the handle mount; and a handle gripping detector configured to electrically detect a gripping state of the auxiliary handle attached to the handle mount, wherein the controller drives the motor in response to the switch being turned on after the handle detector detects attachment of the auxiliary handle and the handle gripping detector detects gripping of the auxiliary handle, in response to the switch being turned on with the attachment and the gripping of the auxiliary handle being detected, controls the motor to rotate at a predetermined first rotational speed, monitors a state of a load on the tip tool, and in response to the monitoring of the state of the load on the tip tool being unchanged for a predetermined period of time, controls the motor to rotate at a second rotational speed lower than the first rotational speed.

2. The grinding tool according to claim 1, wherein the second rotational speed is other than 0 revolutions per minute.

3. The grinding tool according to claim 2, wherein the handle detector and the handle gripping detector include a same sensor.

4. The grinding tool according to claim 2, wherein the state of the load on the tip tool includes a load current from the motor.

5. The grinding tool according to claim 2, wherein the controller controls the motor to rotate at the first rotational speed in response to the controller detecting a change in the state of the load during control of the motor at the second rotational speed.

6. The grinding tool according to claim 2, wherein the grinding tool includes a plurality of the handle mounts.

7. The grinding tool according to claim 2, wherein the housing includes a battery mount.

8. The grinding tool according to claim 1, wherein the handle detector and the handle gripping detector include a same sensor.

9. The grinding tool according to claim 8, wherein the state of the load on the tip tool includes a load current from the motor.

10. The grinding tool according to claim 8, wherein the controller controls the motor to rotate at the first rotational speed in response to the controller detecting a change in the state of the load during control of the motor at the second rotational speed.

11. The grinding tool according to claim 8, wherein the grinding tool includes a plurality of the handle mounts.

12. The grinding tool according to claim 1, wherein the state of the load on the tip tool includes a load current from the motor.

13. The grinding tool according to claim 12, wherein the controller controls the motor to rotate at the first rotational speed in response to the controller detecting a change in the state of the load during control of the motor at the second rotational speed.

14. The grinding tool according to claim 12, wherein the grinding tool includes a plurality of the handle mounts.

15. The grinding tool according to claim 1, wherein the controller controls the motor to rotate at the first rotational speed in response to the controller detecting a change in the state of the load during control of the motor at the second rotational speed.

16. The grinding tool according to claim 15, wherein the grinding tool includes a plurality of the handle mounts.

17. The grinding tool according to claim 1, wherein the controller controls the motor at a rotational speed of 0 revolutions per minute in response to the state of the load on the tip tool being unchanged for the predetermined period of time, resets control of the motor at the rotational speed of 0 revolutions per minute in response to the switch being turned off, and controls the motor to rotate at the first rotational speed in response to the switch being turned on with the attachment and the gripping of the auxiliary handle being detected.

18. The grinding tool according to claim 17, wherein the grinding tool includes a plurality of the handle mounts.

19. The grinding tool according to claim 1, wherein the grinding tool includes a plurality of the handle mounts.

20. The grinding tool according to claim 1, wherein the housing includes a battery mount.

21. A grinding tool, comprising:

a housing accommodating a motor;

a spindle protruding from the housing and being rotatable upon being driven by the motor, the spindle having an end to receive a tip tool;

a switch to be turned on or off in response to an external operation;

a controller configured to control driving of the motor in response to the switch being turned on or off;

a handle mount on the housing to receive an auxiliary handle in a detachable manner; and a handle gripping detector configured to electrically detect a gripping state of the auxiliary handle attached to the handle mount, wherein the controller drives the motor in response to the switch being turned on after the handle gripping detector detects gripping of the auxiliary handle, controls the motor to rotate at a predetermined first rotational speed in response to the switch being turned on with the gripping of the auxiliary handle being detected, controls the motor to rotate at a second rotational speed lower than the first rotational speed in response to a state of a load on the tip tool being unchanged for a predetermined period of time, and controls the motor to rotate at the first rotational speed in response to the controller detecting a change in the state of the load during control of the motor at the second rotational speed.

22. A grinding tool, comprising:

a housing accommodating a motor;

a spindle protruding from the housing and being rotatable upon being driven by the motor, the spindle having an end to receive a tip tool;

a switch to be turned on or off in response to an external operation;

a controller configured to control driving of the motor in response to the switch being turned on or off;

a handle mount on the housing to receive an auxiliary handle in a detachable manner;

a handle detector configured to electrically detect an attachment state of the auxiliary handle to the handle mount; and a handle gripping detector configured to electrically detect a gripping state of the auxiliary handle attached to the handle mount, wherein the controller drives the motor in response to the switch being turned on after the handle detector detects attachment of the auxiliary handle and the handle gripping detector detects gripping of the auxiliary handle, controls the motor to rotate at a predetermined first rotational speed in response to the switch being turned on with the attachment and the gripping of the auxiliary handle being detected, and while power continues to be supplied to the controller, controls the motor at a rotational speed of 0 revolutions per minute in response to a state of a load on the tip tool being unchanged for a predetermined period of time while the switch remains turned on.

* * * * *